US005438826A

United States Patent [19]

Blischke et al.

[11] Patent Number: 5,438,826

[45] Date of Patent: Aug. 8, 1995

[54] METHOD FOR ADJUSTING THE FUEL/AIR MIXTURE FOR AN INTERNAL COMBUSTION ENGINE AFTER AN OVERRUN PHASE OF OPERATION

[75] Inventors: Frank Blischke, Stuttgart; Klaus Hirschmann, Leonberg; Lothar Raff, Remseck; Eberhard Schnaibel, Hemmingen, all of Germany

[73] Assignee: Robert Bosch GmbH, Stuttgart, Germany

[21] Appl. No.: 144,009

[22] Filed: Nov. 1, 1993

[30] Foreign Application Priority Data

Oct. 31, 1992 [DE] Germany ..... 42 36 922.3

[51] Int. Cl.[6] ..... F02D 41/14

[52] U.S. Cl. ..... 60/276; 123/326; 123/682

[58] Field of Search ..... 123/326, 493, 682; 60/276, 277, 285

[56] References Cited

U.S. PATENT DOCUMENTS 4,452,212 6/1984 Takase ..... 123/326 X
5,020,495 6/1991 Plapp ..... 123/326
5,022,225 6/1991 Sawada et al. ..... 60/274
5,228,286 7/1993 Demura ..... 60/276

OTHER PUBLICATIONS

*Patent Abstracts of Japan*, vol. 13, No. 223 (M-829) 24 May 1989, abstract of JP-A-10036943.

*Primary Examiner*—Tony M. Argenbright
*Attorney, Agent, or Firm*—Walter Ottesen

[57] ABSTRACT

The invention is directed to a method for reducing the exhaust-gas emissions of an internal combustion engine which is equipped with a lambda control and a catalytic converter and for which the metering of fuel can be interrupted in dependence upon operating parameters. The method is characterized in that the engine at first is operated with a rich fuel/air mixture during transition from operation without fuel metering to operation with fuel metering. The oxygen deficiency associated therewith compensates the oxygen excess which is stored in the catalytic converter when the metering of fuel is interrupted. An operating state wherein oxygen is loaded therefore occurs quickly after a fuel cutoff. This operating state also defines an optimum at steady state and this is advantageous especially for the conversion of nitrogen oxide.

1 Claim, 7 Drawing Sheets

METHOD FOR ADJUSTING THE FUEL/AIR MIXTURE FOR AN INTERNAL COMBUSTION ENGINE AFTER AN OVERRUN PHASE OF OPERATION

FIELD OF THE INVENTION

The invention relates to a method for adjusting the fuel/air mixture for an internal combustion engine wherein the metering of fuel is interrupted in overrun operation.

BACKGROUND OF THE INVENTION

U.S. Pat. No. 5,022,225 discloses a method which especially relates to the transition from overrun operation to normal operation wherein the engine has a catalytic converter and at least one exhaust-gas probe mounted rearward of the catalytic converter.

The exhaust-gas probe in this patent is arranged rearward of the catalytic converter and is referred to as the rearward exhaust-gas probe in the following. The rearward exhaust-gas probe at least participates in the control of the fuel/air ratio. Dead times occur here which are caused on the one hand by simple gas-run times between mixture formation in the intake pipe and the exhaust-gas probe arranged in the exhaust-gas pipe but, on the other hand, also because of the oxygen storage of the catalytic converter. The catalytic converter still supplies oxygen for a certain time span to the exhaust gas when there is a change of the mixture composition from, for example, a lean mixture (oxygen rich) to a rich mixture (oxygen poor) so that the rearward exhaust-gas probe senses the mixture change after a dead time has passed. This dead time is especially long after an overrun phase of operation wherein the metering of fuel has been cut off. The control intervention, which is based on the signal of the rearward exhaust-gas probe, can lead to an unwanted intense enrichment of the mixture in this situation with a corresponding deterioration of the quality of the exhaust gas. The method of the above-mentioned patent tries to avoid this situation in that the control intervention of the rearward probe is suppressed for a predetermined time after an overrun phase of operation or control is continued with a value which was stored at the start of the overrun operation.

It has been shown that the quality of the exhaust gas after the overrun operation is not deteriorated exclusively by the described overreaction of the control. For example, an increased emission of nitrogen develops after an overrun phase of operation whereas the described excessive enrichment of the mixture leads to increased carbon dioxide and carbon monoxide emissions during operations which follow the overrun operation.

SUMMARY OF THE INVENTION

In view of the foregoing, it is an object of the invention to provide a method which avoids the above-described overreaction of the control while at the same time avoiding the increase of nitrogen oxide emission after an overrun phase of operation.

The method of the invention is for adjusting the fuel/air mixture for an internal combustion engine wherein the metering of fuel can be interrupted in dependence upon operating parameters. The engine is equipped with a lambda control and a catalytic converter and the method includes the steps of: operating the engine in a transition from a first state wherein no fuel is metered to the engine to a second state wherein fuel is metered to the engine; and, driving the engine when the transition occurs first with a fuel/air mixture having a fuel portion which is increased relative to a stoichiometric composition thereby carrying out an enrichment of the mixture to form a rich mixture.

With the targeted adjustment of a rich mixture (oxygen deficiency) after an overrun phase of operation, the excess oxygen stored in the catalytic converter during the overrun operation is consumed. As a result, that state of operation is again reached after a shortest possible time which corresponds to the optimal operating point of the catalytic converter with reference to the oxygen charge. In this way, catalytic converter operation is optimized in a sense that the nitrogen oxide conversion, which had been reduced as a consequence of the displaced operating point, is improved. At the same time, the targeted enrichment prevents incorrect enrichment by the rearward exhaust-gas probe.

BRIEF DESCRIPTION OF THE DRAWINGS

The invention will now be described with reference to the drawings wherein.

DESCRIPTION OF THE PREFERRED EMBODIMENTS OF INVENTION

Figure 1:
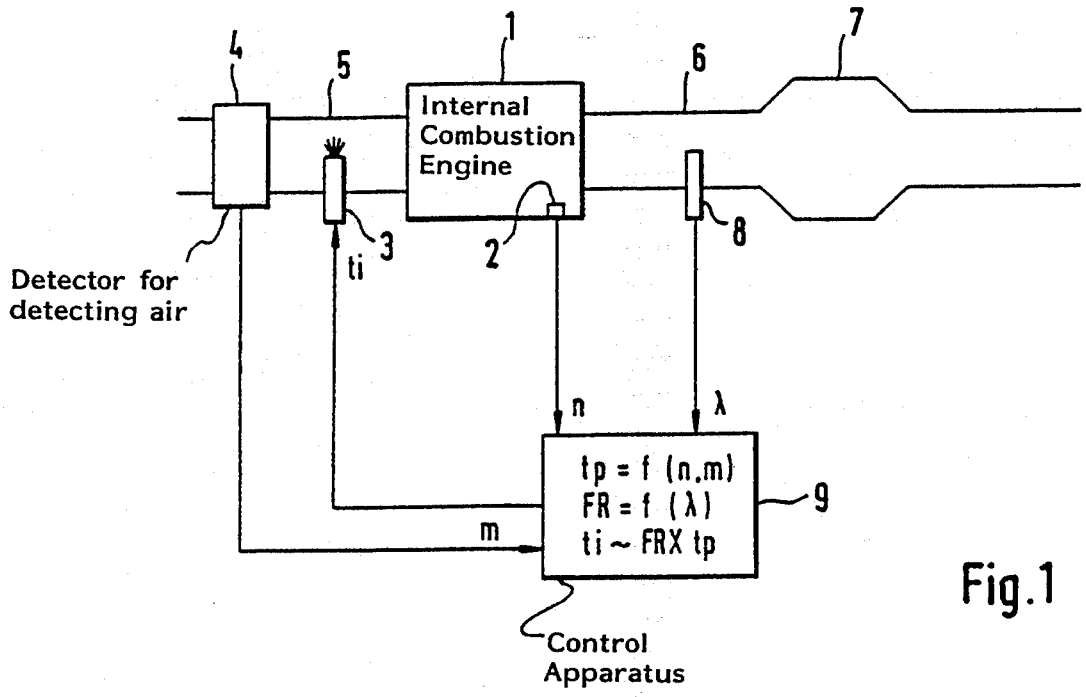
FIG. 1 is a schematic of a control loop for controlling the mixture for an internal combustion engine having a single exhaust-gas probe and a control unit.

FIG. 1 shows a control loop which includes an internal combustion engine 1, an rpm sensor 2, a fuel-metering device 3 and detector means 4 for detecting the inducted air quantity (m) in an intake pipe 5, an exhaust-gas pipe 6 having an exhaust-gas probe 8 arranged forward of a catalytic converter 7 and a control apparatus 9.

The basic function of the control loop is to process the signals of rpm (n), air quantity (m) and mixture composition (λ) to a fuel-metering signal ti with the aid of the control apparatus. The fuel-metering device 3 is driven with this fuel-metering signal ti. A preliminary fuel-metering signal tp is formed as a function of air quantity and rpm and is multiplicatively combined with a corrective factor FR which considers the deviation of the mixture composition λ from a desired value.

In addition to this basic function, numerous other functions can be carried out which are required or are useful for the operation of the internal combustion engine. These functions include the following which are only exemplary: ignition, exhaust-gas return and tank venting. These functions can be combined with the invention without difficulty and are not further discussed here for reasons of clarity.

Figure 2:
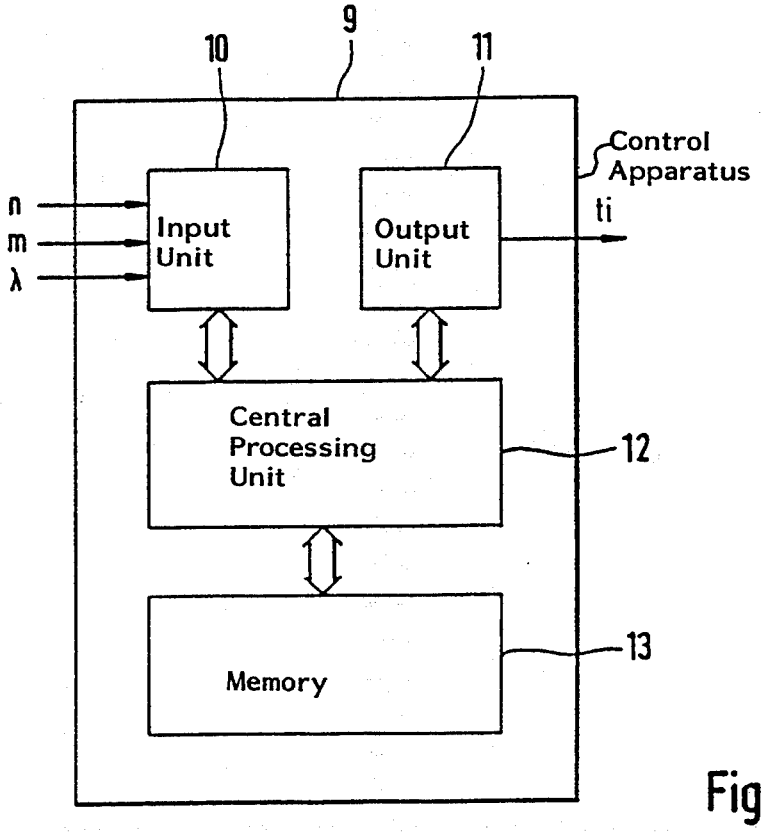
FIG. 2 shows the basic configuration of the control apparatus shown in FIG. 1 and how this apparatus is used for carrying out the method of the invention.

FIG. 2 shows the basic structure of a control apparatus 9 suitable for the sequence control of the method according to the invention. The above-mentioned signals with respect to air quantity (m), rpm (n) and mixture composition λ are supplied to an input unit 10. An output unit 11 emits in this case the fuel-metering signal ti. A central processing unit 12 is disposed between input unit 10 and output unit 11 and performs processing in accordance with a program stored in the memory 13 while accessing data likewise stored in the memory 13 in the form of characteristic fields.

Figure 3:
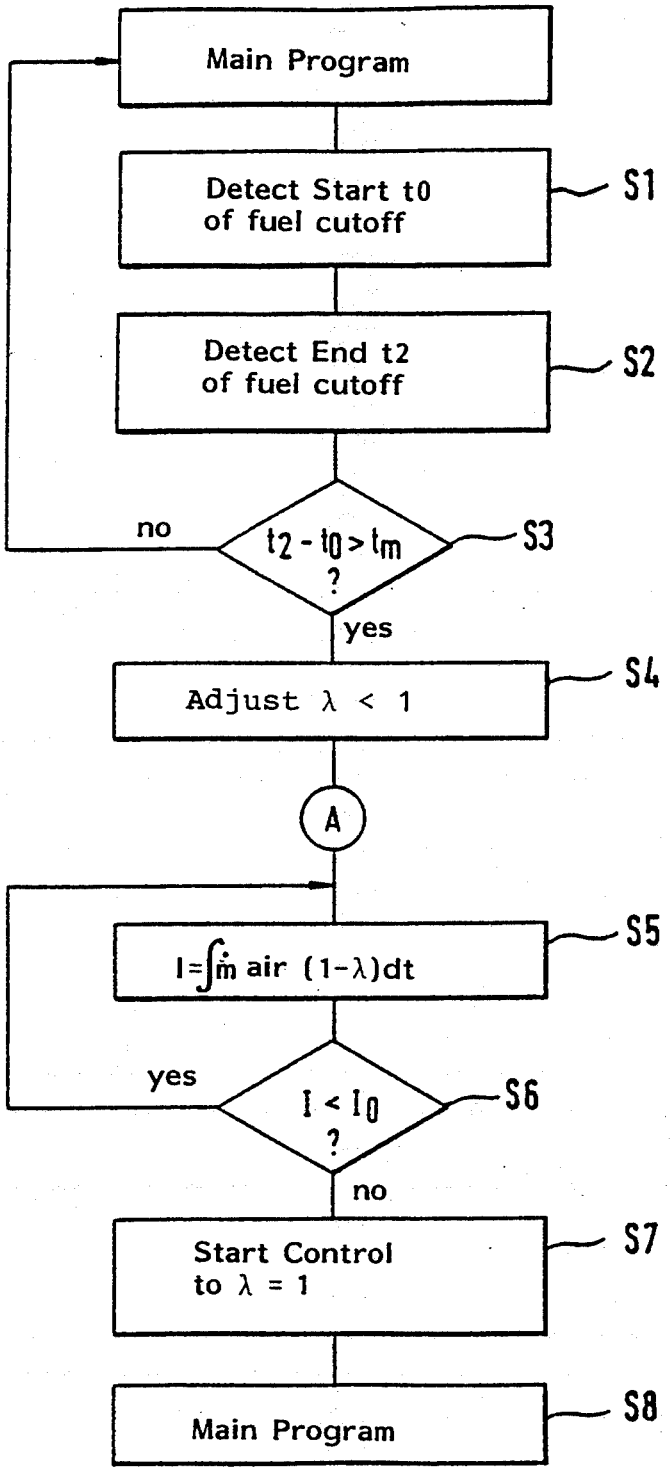
FIG. 3 shows a flowchart for carrying out the method of the invention.

An example of a program suitable for carrying out the invention is shown in FIG. 3. In accordance with this program, a main program is first run through during the operation of the internal combustion engine and performs the above-mentioned basic function of the control loop shown and also further functions also mentioned above. An interruption of the fuel supply occurs at a time point t0, for example, at the start of the overrun phase of operation. Start point t0 and end point t2 of the fuel cutoff are detected in steps S1 and S2.

In step S3, a check is made as to whether the duration t2−t0 of the overrun operation has exceeded a predetermined minimum time duration tm. The background of this measure is that the displacement of the operating point of the catalytic converter described above starts only after a predetermined overload with oxygen. If the oxygen input (connected with the fuel cutoff) in the catalytic converter is comparatively small, a back displacement of the operating point because of targeted mixture enrichment is not required. Accordingly, a return to the main program occurs in step S3 when this inquiry is answered in the negative. In contrast, if the fuel cutoff takes longer than the pregiven time duration tm, then a targeted mixture enrichment is carried out in a step S4 when the supply of fuel is resumed, preferably, in the order of magnitude of 5% to 10%.

For this purpose, the preliminary fuel-metering signals tp can be multiplied by a factor in a range of 1.05 to 1.1 or control parameters can be so changed that a rich shift in the order of magnitude given above results. The following then can be considered: a shift of the control desired value, unsymmetrical delays of the reaction of the exhaust-gas probe signal on the changes of the mixture composition, unsymmetrical integrator slopes or unsymmetrically high proportional jumps.

The steps S5 and S6 adapt the duration of the mixture enrichment to the air quantity (m) drawn in by the internal combustion engine. For this purpose, the time integral I of the product of the air mass flow (m), which is referred to the time unit, and the deviation of the mixture composition λ from the value 1 is formed in step S5. This integral defines a measure for the oxygen deficiency in the exhaust gas caused by the targeted enrichment which consumes the oxygen excess stored during the overrun operation in the catalytic converter.

In step S6, the above-mentioned integral is compared to a threshold value I0 which represents the storage capacity of the catalytic converter and therefore to a certain extent the oxygen excess stored in the catalytic converter during the overrun operation. In the context of this embodiment, a fixed value is provided for this purpose and is characteristic for a catalytic converter of the type used in an average state of deterioration. The mixture enrichment is maintained as long as the computed oxygen deficiency I is less than the threshold value I0. Exceeding the threshold value in step S6 ends the targeted enrichment via step S7 and begins a control to λ=1 and leads into the main program via step S8.

Figure 4:
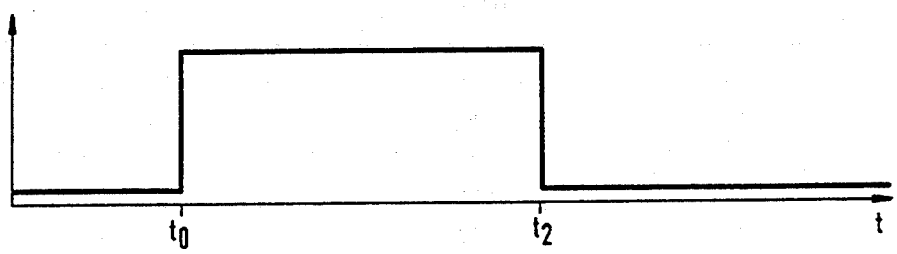
FIG. 4*a* shows the trace of a fuel cutoff signal as a function of time.
FIG. 4*b* shows a signal trace which results when the enrichment takes place via a control factor FR.
Figure 4:
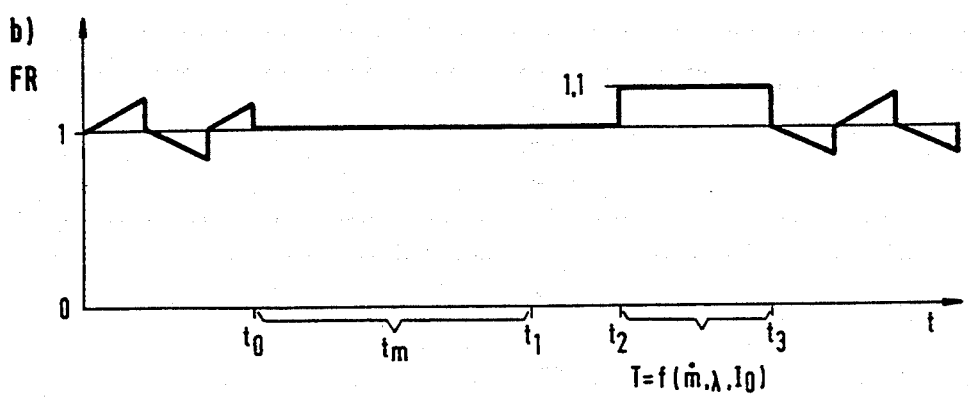

FIG. 4 shows the trace of a fuel cutoff signal as a function of time with the high signal level symbolizing an interruption of the fuel metering. FIG. **4*b* shows a signal trace characteristic for the invention which results when the enrichment is controlled via the correction factor FR. The controlled metering of fuel with the correction factor FR takes place up until time point t0 and the correction factor FR oscillates about the mean value 1. At time point t0, the metering of fuel is interrupted until time point t2 and the now ineffective correction factor FR is set, for example, to its mean value 1. Since the time duration of the fuel cutoff likewise exceeds the shown minimum duration tm, the enrichment according to the invention is carried out when fuel metering is resumed at time point t2. In the embodiment shown, the multiplicatively acting correction factor FR is increased by 10% to the value 1.1 and held at this value until time point t3. As shown in connection with FIG. 3, this time duration T=t3−t2 is adapted to the air-mass flow (m), the degree of enrichment (1−λ) and the threshold value I0** specific to the catalytic converter and is therefore variable as a function of these quantities. The control to λ=1 again resumes after the end of the enrichment at time point t3.

Figure 5:
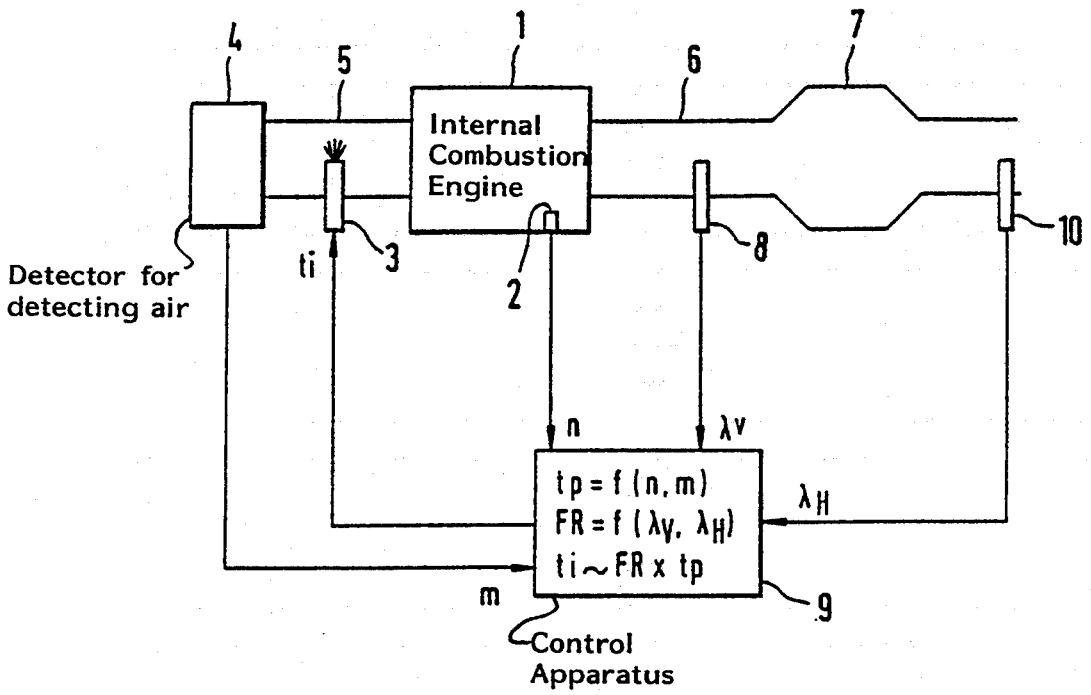
FIG. 5 is a schematic showing a control loop for controlling the mixture of an internal combustion engine which has been expanded relative to the control loop shown in FIG. 1 by including a rearward exhaust-gas probe.

FIG. 5 shows a control loop for controlling the mixture of an internal combustion engine which is expanded with respect to the embodiment of FIG. 1 in that an exhaust-gas probe 10 is mounted rearward of the catalytic converter. In this way, the basic function of the control loop described with respect to FIG. 1 can be expanded with a monitoring of the catalytic converter as well as with a supplemented control intervention via the signal $\lambda_H$ of the rearward exhaust-gas probe. An expansion of this kind is already known. In the context of an embodiment of the invention, the signal of the rearward exhaust-gas probe triggers the end of the targeted mixture enrichment.

Figure 6:
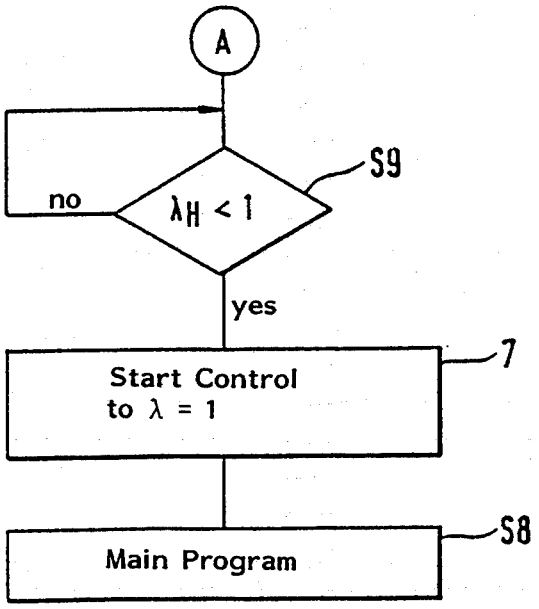
FIG. 6 shows a flowchart of an embodiment which includes the rearward exhaust-gas probe.

The corresponding method sequence is shown in FIG. 6 and runs up to mark A in the same manner as the step sequence S1 to S4 shown in FIG. 3. In step S9, an inquiry is made as to whether an oxygen concentration corresponding to λ<1 is present rearward of the catalytic converter. This is then typically the case when the oxygen deficiency introduced in accordance with the invention has consumed the oxygen excess stored in the catalytic converter in the previous overrun phase of operation. Only when the rearward exhaust-gas probe signalizes this condition, is there a control to λ=1 via steps S7 and S8 and a return to the main program.

FIGS. *7a* to *7c* show this procedure. FIGS. *7a* and *7b* correspond substantially to FIGS. **4*a* and 4*b* and therefore require no explanation at this point. The only difference results from the formula-based expression for the time duration T of the enrichment. In this embodiment, the expression is no longer dependent from a fixed value I0**; instead, the expression is dependent upon the signal of the rearward exhaust-gas probe. This can be seen in FIG. *7c* which shows the signal $U_{SH}$ of the rearward exhaust-gas probe.

The signal of such a probe must not correspond in every detail to the trace shown here. Thus, it can happen, especially with a deteriorated catalytic converter, that the rearward exhaust-gas probe supplies an image of the control oscillation and therefore, for example, oscillates in the range of t=0 to time point t0. For a very old catalytic converter, no enrichment after the overrun operation is necessary and permissible because of a storage capacity which is no longer provided. The signal performance essential for the invention is in the delayed reaction of the rearward exhaust-gas probe to the start of the fuel cutoff and the enrichment period which follows. The voltage $U_{SH}$ of the probe drops to a low value characteristic for a lean mixture after a certain time span after the catalytic converter is flooded with oxygen. The signal at first does not change during the subsequent enrichment period. Only when the oxygen excess stored in the catalytic converter is consumed by the oxygen deficiency (associated with the enrichment) in the exhaust gas does the signal of the rearward probe increase and triggers the end of the enrichment when this signal exceeds a threshold value S at time point t3.

Figure 8:
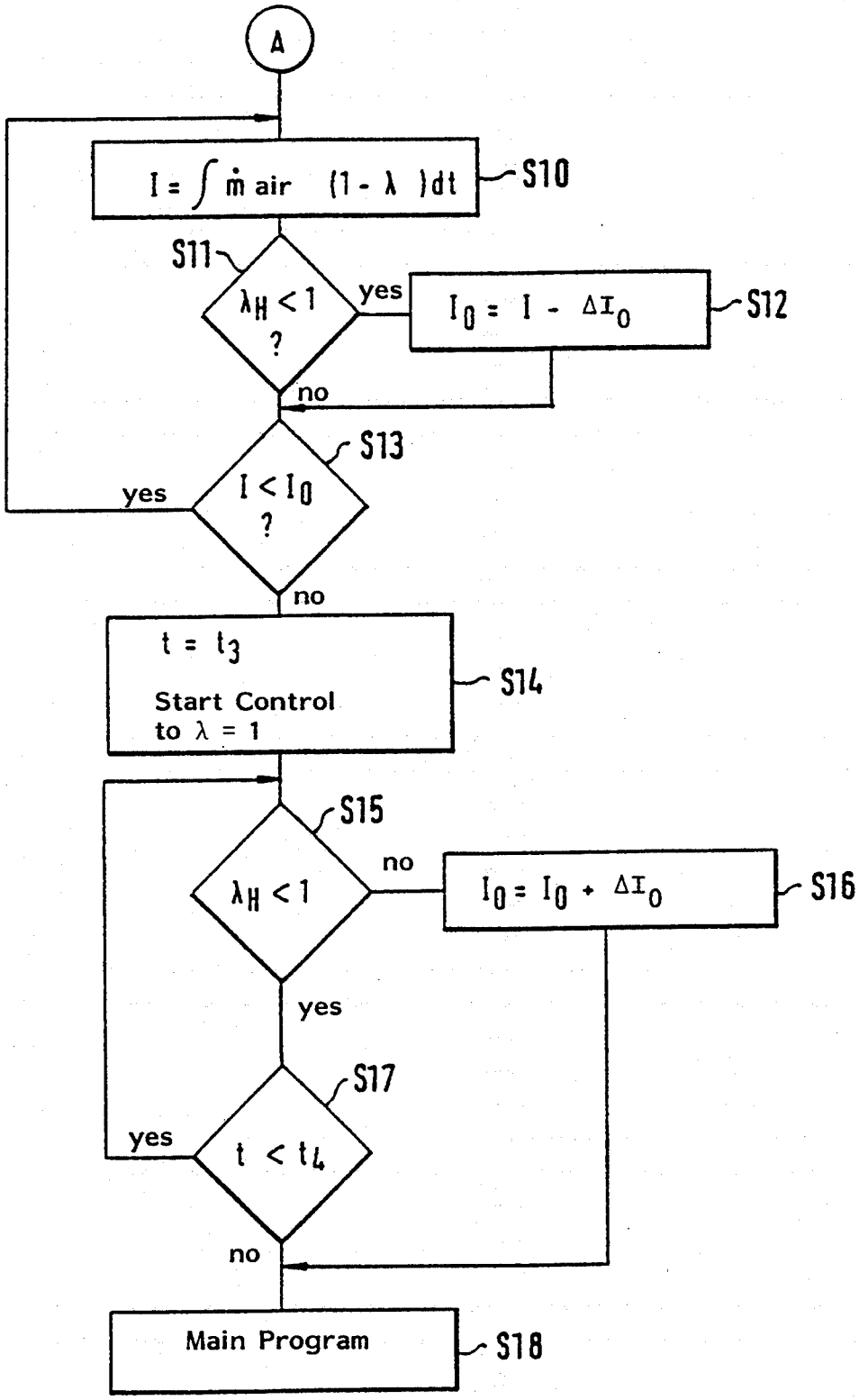
FIG. 8 shows a flowchart of another embodiment of the invention.

A further embodiment which also uses signals of a rearward exhaust-gas probe as described above is shown in the flowchart of FIG. 8.

This preferred embodiment joins advantageous features of both embodiments described above and avoids their disadvantages.

In a manner similar to the first embodiment, the duration of the mixture enrichment is here adapted to the air mass flow m through the internal combustion engine. For this purpose, and after passing through the mark A, the time integral of the product of the air-mass flow m and the deviation of the mixture composition λ from the value 1 is formed in step S10. As already described with respect to FIG. 3, this integral defines a measure for the oxygen deficiency in the exhaust gas produced by the targeted enrichment. This oxygen deficiency to an extent consumes the oxygen excess stored in the catalytic converter during the overrun operation.

Step S11 introduces elements of the second embodiment into the method. Here, with the aid of the signal of the rearward exhaust-gas probe, a check is made as to whether the targeted mixture enrichment already is noticeable rearward of the catalytic converter. If this is not the case, then the value of the integral is compared to a threshold value I0 in Step S6. The enrichment is continued until I0 is exceeded.

When the value of I0 is selected to be too great, then the mixture enrichment becomes noticeable in the signal of the rearward exhaust-gas probe already before the threshold value I0 is exceeded. For this case, the step S12 is provided which imparts a new lesser value IΔI0 to the threshold value I0. The inquiry in the next step S13 is then always negative which leads to the end of the enrichment because of a control to λ=1 in step S14. If I0 is reduced in step S12, then the inquiry in step S15 is negative because the rearward probe then already signals a rich mixture composition. The step S17 leads into the main program.

Even if I0 had been correctly selected, that is, the enrichment quantity was precisely correct, then the rearward probe would show a change only later than t3, namely at time point t3' because of the gas running time. The adaptation value is likewise reduced with a change to rich during this gas running time (minimum transport time) after the end of the enrichment. Even this gas running time can be pregiven in dependence upon the inducted air quantity.

If in contrast, the value I0 is selected too small, then there is a movement out of the loop made up of steps S10 to S13 without the detour via step S12. In this case, a check is made after the enrichment at time point t3 (step S14) in a loop made up of the steps S15 and S17 as to whether the enrichment is still noticeable in the signal of the rearward exhaust-gas probe up to the time point t4. I0 selected too small is equal to an inadequate reduction of the oxygen stored in the catalytic converter during overrun operation and leads to a negative answer in the inquiry of step S15. As a consequence, a step S16 follows wherein the value I0 for the next overrun phase of operation is increased by the value ΔI0. The step S18 leads back into the main program.

The preferred embodiment of the invention permits in this manner an adaptation of the duration of the targeted enrichment over many overrun operating phases.

Figure 7:
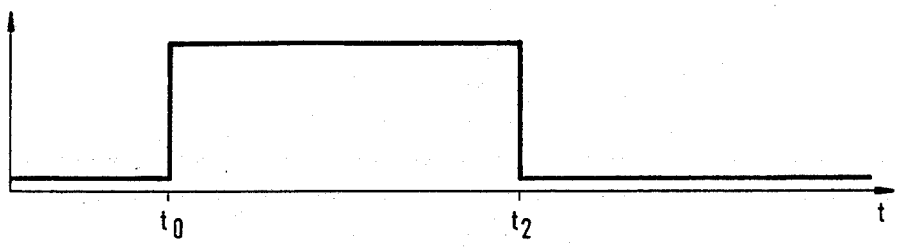
FIGS. 7*a* to 7*c* show the signal traces for the embodiment shown in FIG. 6.
Figure 7:
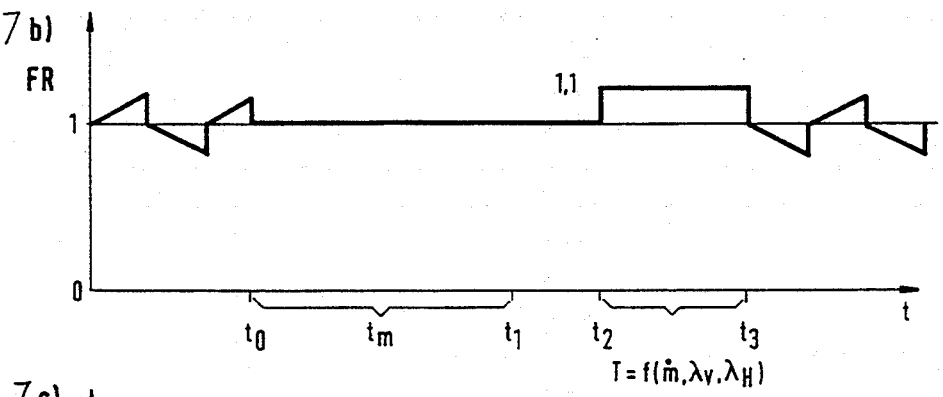
Figure 7:
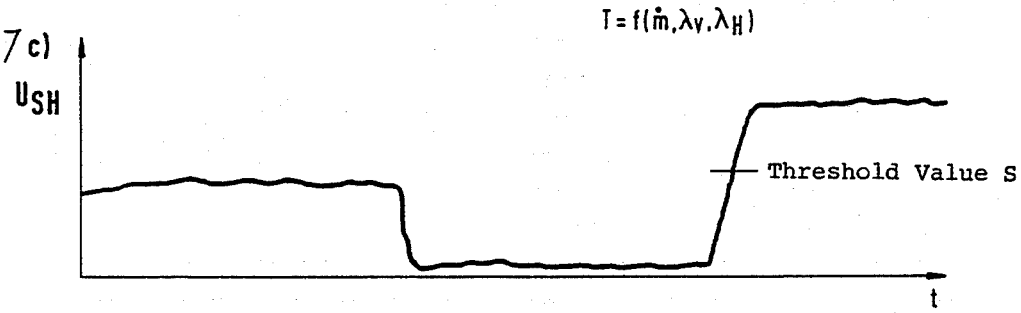
Figure 9:
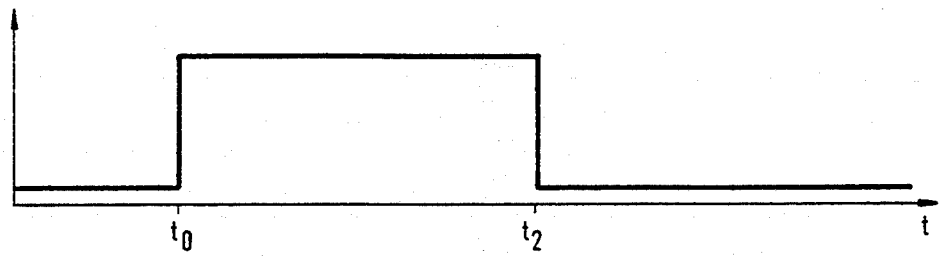
FIGS. 9*a* to 9*c* show the signal traces for the embodiment of FIG. 8.
Figure 9:
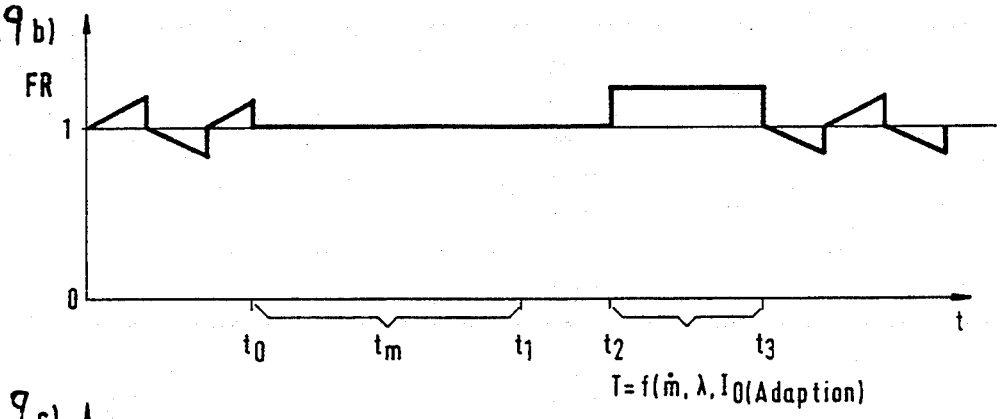
Figure 9:
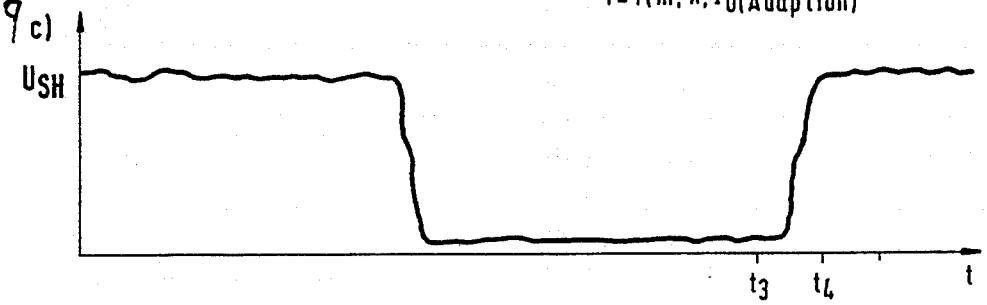

FIGS. 9*a* to 9*c* show the above procedure. FIGS. 9*a* and 9*b* correspond substantially to FIGS. 7*a* and 7*b* and therefore require no explanation at this point. The only difference results here also from the formula-based expression for the time duration T of the enrichment. In this embodiment, T is dependent from a value I0 (adaptation) which is adapted over many overrun operation phases. FIG. 8*c* shows a trace of the signal of the rearward exhaust-gas probe for a suitably adapted value I0. Here, the enrichment following overrun operation at the end of the enrichment is noticeable but within the waiting time (t3, t4) in the signal of the rearward exhaust-gas probe.

It is conceivable not to activate the enrichment immediately after the end of the overrun operation; instead, only above a load/rpm threshold especially above idle.

It is understood that the foregoing description is that of the preferred embodiments of the invention and that various changes and modifications may be made thereto without departing from the spirit and scope of the invention as defined in the appended claims.

What is claimed is:

1. A method for adjusting the fuel/air mixture for an internal combustion engine wherein the metering of fuel is interrupted in dependence upon operating parameters, the engine being equipped with a lambda control and a catalytic converter, the lambda control including a lambda probe arranged rearward of the catalytic converter, the method comprising the steps of:

operating said engine in a transition from a first state wherein no fuel is metered to the engine to a second state wherein fuel is metered to the engine;

driving said engine when said transition occurs first with a fuel/air mixture having a fuel portion which is increased relative to a stoichiometric composition thereby carrying out an enrichment of said mixture to form a rich mixture; and, carrying out said enrichment until said lambda probe registers an exhaust gas composition which is characteristic of a rich mixture.

* * * * *

UNITED STATES PATENT AND TRADEMARK OFFICE

CERTIFICATE OF CORRECTION

PATENT NO. : 5,438,826

DATED : August 8, 1995

INVENTOR(S) : Frank Blischke, Klaus Hirschmann, Lothar Raff and Eberhard Schnaibel

It is certified that error appears in the above-identified patent and that said Letters Patent is hereby corrected as shown below:

In column 3, line 44: delete "preferably," and substitute -- preferably -- therefor.

In column 3, line 58: delete "(m)" and substitute -- $\dot{m}$ -- therefor.

In column 4, line 29: delete "(m)" and substitute -- $\dot{m}$ -- therefor.

In column 5, lines 31 and 32: delete "air mass flow m" and substitute -- air-mass flow $\dot{m}$ -- therefor.

In column 5, line 34: delete " flow m" and substitute -- flow $\dot{m}$ -- therefor.

Signed and Sealed this

Second Day of January, 1996

*Attest:*

Bruce Lehman

BRUCE LEHMAN

*Attesting Officer*

*Commissioner of Patents and Trademarks*